US009027267B2

(12) United States Patent
Flores et al.

(10) Patent No.: US 9,027,267 B2
(45) Date of Patent: May 12, 2015

(54) LATCH FOR USE IN A LATCH SYSTEM OF AN EXCAVATING MACHINE BUCKET

(71) Applicant: Minetec S.A., Renca, Santiago (CL)

(72) Inventors: Antonio Flores, Renca (CL); Bernardo Vera, Renca (CL); Claudio Zamorano, Renca (CL)

(73) Assignee: Minetec S.A., Santiago (CL)

( * ) Notice: Subject to any disclaimer, the term of this patent is extended or adjusted under 35 U.S.C. 154(b) by 24 days.

(21) Appl. No.: 13/709,734

(22) Filed: Dec. 10, 2012

(65) Prior Publication Data

US 2013/0340300 A1 Dec. 26, 2013

(30) Foreign Application Priority Data

Jun. 21, 2012 (CL) ..... 1693-2012

(51) Int. Cl.
*E02F 3/407* (2006.01)

(52) U.S. Cl.
CPC ..... *E02F 3/4075* (2013.01)

(58) Field of Classification Search
USPC ..... 37/396, 398, 399, 401, 444, 445
See application file for complete search history.

(56) References Cited

U.S. PATENT DOCUMENTS

| | | | | | |
|---|---|---|---|---|---|
| 986,522 | A * | 3/1911 | Thomson | 37/445 |
| 1,566,437 | A * | 12/1925 | Simpson | 37/444 |
| 2,544,682 | A * | 3/1951 | Hilgeman | 292/198 |
| 4,939,855 | A * | 7/1990 | McCreary, Jr. | 37/444 |
| 5,815,958 | A * | 10/1998 | Olds et al. | 37/444 |
| 6,467,202 | B1 * | 10/2002 | Brown, Jr. | 37/445 |
| 8,136,272 | B2 * | 3/2012 | Hren et al. | 37/445 |
| 8,590,180 | B2 * | 11/2013 | Hren et al. | 37/445 |
| 2007/0107269 | A1 * | 5/2007 | Hren et al. | 37/398 |
| 2009/0278372 | A1 * | 11/2009 | Liebert | 296/39.1 |
| 2010/0212194 | A1 * | 8/2010 | Hren et al. | 37/445 |
| 2011/0146114 | A1 * | 6/2011 | Hren et al. | 37/445 |
| 2012/0192465 | A1 * | 8/2012 | Opazo | 37/444 |

* cited by examiner

*Primary Examiner* — Matthew D. Troutman
(74) *Attorney, Agent, or Firm* — Hamre, Schumann, Mueller & Larson, P.C.

(57) ABSTRACT

A rolled latch for excavator buckets that increases duration and facilitates maintenance work since it is changed instead of requiring weld fill, and includes three primary parts: a core, a top wear plate and a bottom wear plate. The parts are manufactured of rolled steel. The core remains between the top and bottom wear plates, and the top and bottom wear plates are welded to the core.

17 Claims, 4 Drawing Sheets

LATCH FOR USE IN A LATCH SYSTEM OF AN EXCAVATING MACHINE BUCKET

FIELD OF APPLICATION OF THE INVENTION

This use model is related to the field of earth movement equipment and refers specifically to a latch used in an excavating machine bucket to latch a door of the bucket closed.

BACKGROUND

The latch for excavator buckets meets the function of locking the excavator's bucket prior to beginning loading in order to avoid the cargo falling out once material has entered it and keeps it secure during transport done by the excavator to the unloading place. At the moment of unloading, the bucket unlocks to allow the material to be released in the unloading place, by activating the latch. It can therefore be deduced from the above that this element locks and unlocks many times during the work of loading and unloading an excavator's bucket, and due to wear it requires repair after a certain number of hours of work. This involves maintenance time and time when the equipment is out of service.

In the present day, latches are cast and made from one sole piece, so it is necessary to disassemble and refill the wear with solder and once repaired, reassemble them.

SUMMARY OF THE INVENTION

The construction of a new type of latch is proposed, which is formed of rolled steel and comprised of three primary parts: one core and two wear plates. The wear plates comprise a repair kit. The advantages of this new rolled steel latch include exceptional resistance to impact, which guarantees a longer useful life and improved mechanical resistance.

All of the above has a comparative design advantage which allows fast maintenance of the component, since to service it only the wear plates must be replaced and filling with solder as with the standard latch is not necessary.

This new latch design has the advantage that when the wear kit is changed, the latch continues to have the same characteristics as when it was new, unlike standard latches that are repaired with solder and have a shorter duration.

DETAILED DESCRIPTION OF THE INVENTION

Figure 1:
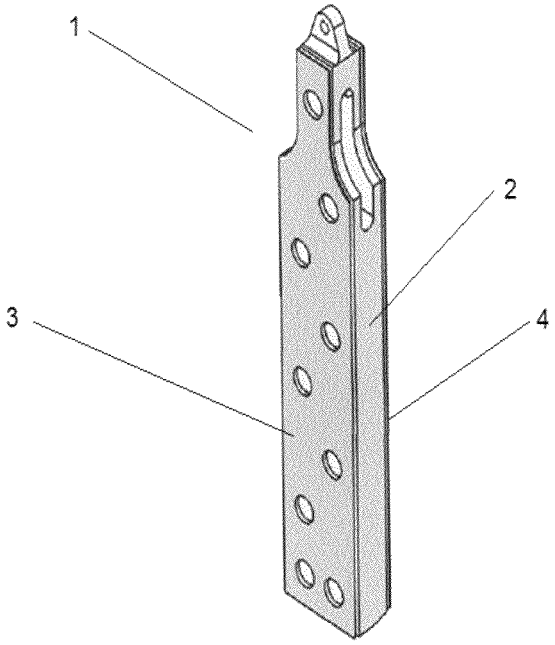
FIG. 1 shows an isometric view of the core of the latch with its top and bottom wear plates.

The shovel bucket of some kind of shovels often has a bucket door or cover that is hinged to the shovel bucket. Shovel buckets traditionally include a latch system with a mechanical or electro-mechanical actuating mechanism to operate the latch system and open or close the bucket door. The latch system often includes a latch and an insert, with the latch penetrating the insert to lock the bucket door. The latch mechanism keeps the bucket door locked in a closed position until the actuating mechanism takes out the latch from the insert which allows the door to swing open.

The rolled steel latch (1) for the excavator bucket (6) is manufactured with a combination of rolled steel that provides improved resistance to impact and wear. This is achieved using a core (2) manufactured in high-resistance steel with a hardness of 270 HB to 370 HB. The work faces of the core (2) are covered with wear plates with high resistance to wear. For example, the work faces are covered by top (3) and bottom (4) wear plates whose surface hardness is of 450 HB or 500 HB. The wear plates can be secured to the core by welding applied to the perforations (5) present in the two wear plates and along the perimeter of these wear plates.

The weld type used to join the top (3) and bottom (4) wear plates to the core can be of the flux cored arc welding (FCAW) type, shielded metal arc welding (SMAW) type or solid MIG (GMAW) type. The weld area of the perforations is along the entire perimeter of the perforations (5) and the perforations may or may not be completely filled by the weld material.

For the process of changing the wear plates, the weld zones are gouged along the length of the perimeter of the perforations (5) and the perimeter of the wear plates to remove these wear plates.

The latch (1) has a higher resistance to wear, since it has a layer of wear plates on its contact surfaces, specifically the top (3) and bottom (4) wear plates which are manufactured as stated in 450 HB or 500 HB steel, which guarantees a longer duration than the standard latch.

Figure 2:
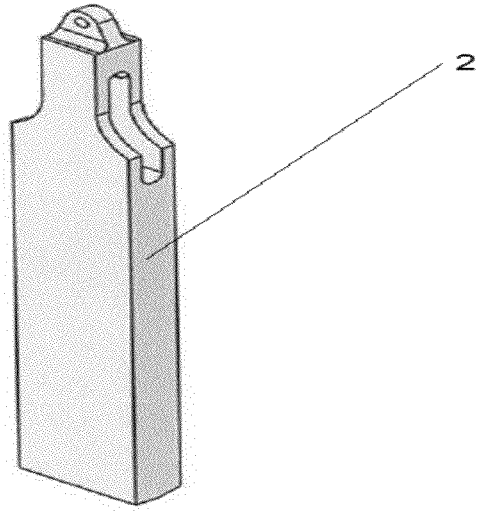
FIG. 2 shows an isometric view of the core of the latch.
Figure 3:
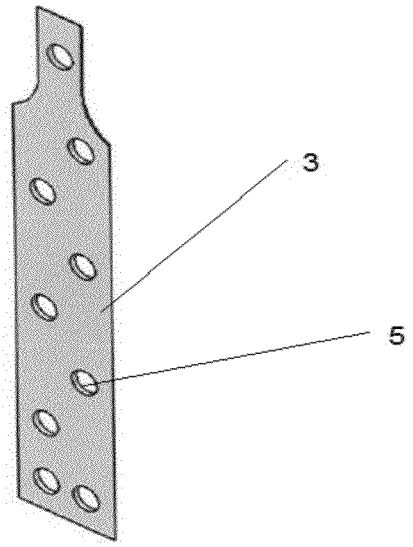
FIG. 3 shows the top wear plate of the latch.
Figure 4:
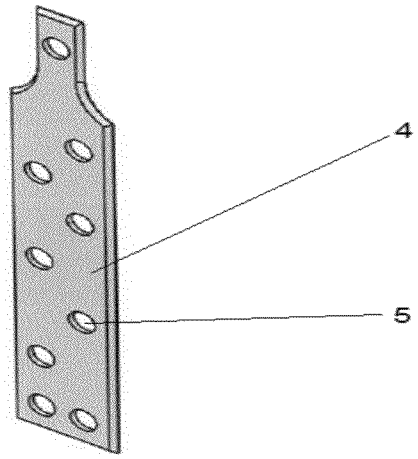
FIG. 4 shows the bottom wear plate of the latch.
Figure 5:
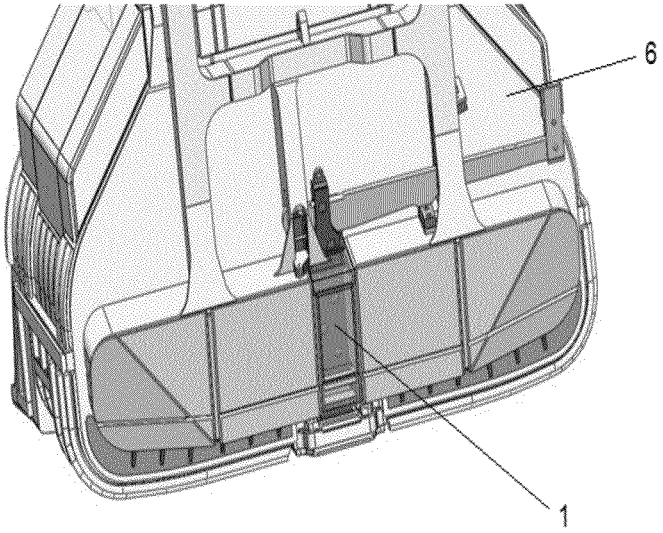
FIG. 5 shows an isometric view of an excavator bucket with a transparent view of the location of the latch.
Figure 6:
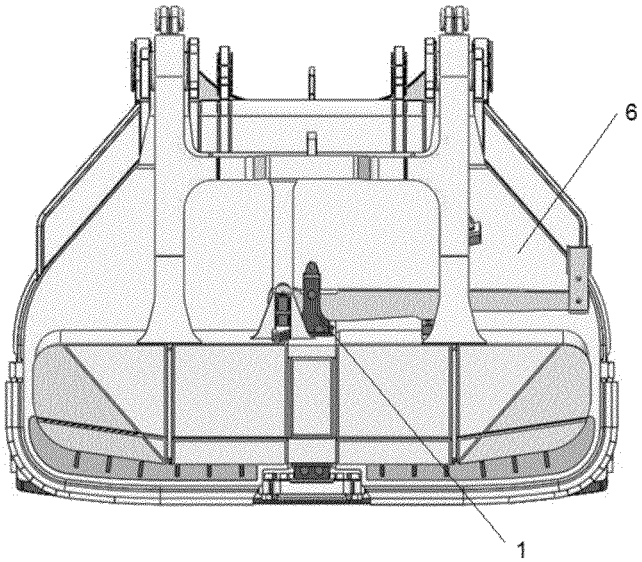
FIG. 6 shows a front view of an excavator bucket with a view of the location of the latch.
Figure 7:
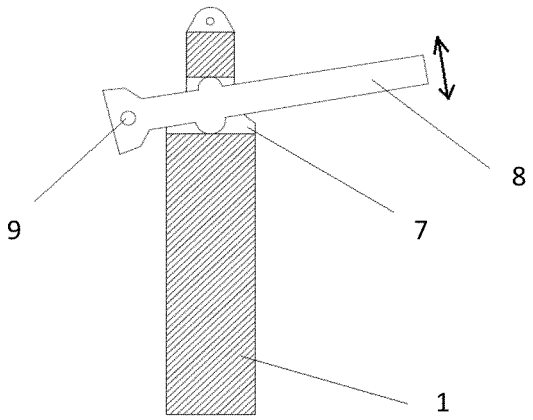
FIG. 7 schematically depicts operation of the latch.

As shown in FIGS. 1 and 2, the core (2) includes a slot (7) that extends through the core. With reference to FIG. 7, in use, the slot (7) allows a latch lever (8) to pass through the latch (1) from side to side. The lever (8) pivots about a fixed point (9) on the bucket (6) and moves up or down moving the latch also up and down and allowing the latch enter or exit the bucket insert (10), locking or releasing the bucket door.

The invention claimed is:

1. An excavator bucket latch, comprising:

a core having first and second work faces, a first wear plate attached to the first work face, a second wear plate attached to the second work face, with the core being disposed between the first wear plate and the second wear plate;

the core, the first wear plate and the second wear plate are manufactured of rolled steel; and the first and second wear plates each include a perimeter edge and a plurality of perforations, weld material is disposed in the perforations between a perimeter of each perforation and the core that connect the first and second wear plates to the core, and weld material is disposed along the perimeter edge of the first and second wear plates that connects the wear plates to the core.

2. The excavator bucket latch according to claim 1, wherein the core is manufactured of steel with a hardness between 270 HB and 370 HB.

3. The excavator bucket latch according to claim 1, wherein the first and second wear plates are manufactured of steel with a hardness between 450 to 500 HB.

4. The excavator bucket latch according to claim 1, wherein the first and second wear plates are detachably attached to the core.

5. The excavator bucket latch according to claim 1, wherein the first and second wear plates cover the entire area of the first and second work faces of the core.

6. The excavator bucket latch according to claim 1, wherein the perforations are completely filled by the weld material.

7. The excavator bucket latch according to claim 1, wherein the weld material in the perforations is disposed around the entire perimeter of each of the perforations and the weld material that connects the wear plates to the core is disposed along the entire perimeter edge of each of the wear plates.

8. The excavator bucket latch according to claim 1, further comprising a slot formed through the core, the slot being generally parallel to the first and second work faces of the core.

9. The excavator bucket latch according to claim 8, wherein the core and the wear plates each have a first section with parallel first side edges that are spaced apart from one another by a first distance, a second section with parallel second side edges that are spaced apart from one another by a second distance that is less than the first distance, and a curved section with curved side edges that interconnect the first side edges with the second side edges; and the slot extends through a portion of the first section, a portion of the second section and the curved section of the core.

10. An excavator bucket, comprising:

a bucket;

a bucket door hinged to the bucket so as to be swing between a closed position and an open position relative to the bucket;

a latch system for retaining the bucket door at the closed position, the latch system includes a latch that is movable from a locked position to a release position, a latch lever that is engaged with the latch for moving the latch between the locked position and the release position, and an insert that receives a portion of the latch at the locked position thereof;

the latch includes:

a core having first and second work faces, a first wear plate attached to the first work face, a second wear plate attached to the second work face, with the core being disposed between the first wear plate and the second wear plate;

the core, the first wear plate and the second wear plate are manufactured of rolled steel; and the first and second wear plates each include a perimeter edge and a plurality of perforations, weld material is disposed in the perforations between a perimeter of each perforation and the core that connect the first and second wear plates to the core, and weld material is disposed along the perimeter edge of the first and second wear plates that connects the wear plates to the core.

11. The excavator bucket according to claim 10, wherein the core is manufactured of steel with a hardness between 270 HB and 370 HB.

12. The excavator bucket according to claim 10, wherein the first and second wear plates are manufactured of steel with a hardness between 450 to 500 HB.

13. The excavator bucket according to claim 10, wherein the first and second wear plates cover the entire area of the first and second work faces of the core.

14. The excavator bucket according to claim 10, wherein the perforations are completely filled by the weld material.

15. The excavator bucket according to claim 10, wherein the weld material in the perforations is disposed around the entire perimeter of each of the perforations and the weld material that connects the wear plates to the core is disposed along the entire perimeter edge of each of the wear plates.

16. The excavator bucket according to claim 10, further comprising a slot formed through the core, the slot being generally parallel to the first and second work faces of the core, and the latch lever extends through the slot.

17. The excavator bucket according to claim 16, wherein the core and the wear plates each have a first section with parallel first side edges that are spaced apart from one another by a first distance, a second section with parallel second side edges that are spaced apart from one another by a second distance that is less than the first distance, and a curved section with curved side edges that interconnect the first side edges with the second side edges; and the slot extends through a portion of the first section, a portion of the second section and the curved section of the core.

* * * * *